United States Patent [19]

Bickley et al.

[11] 4,249,150

[45] Feb. 3, 1981

[54] HIGH POWER RF RELAY SWITCH

[75] Inventors: Robert H. Bickley, Scottsdale; James E. Olivenbaum, Mesa, both of Ariz.

[73] Assignee: Motorola Inc., Schaumburg, Ill.

[21] Appl. No.: 35,028

[22] Filed: Apr. 30, 1979

[51] Int. Cl.[3] ..... H01P 1/10; H01P 1/15; H01P 1/12

[52] U.S. Cl. ..... 333/262; 307/317 R; 335/5

[58] Field of Search ..... 333/258, 262, 101, 103; 335/1, 4, 5, 11, 173, 219; 361/11, 2, 8, 13; 307/317

[56] References Cited

U.S. PATENT DOCUMENTS

| | | | |
|---|---|---|---|
| 3,204,151 | 8/1965 | Kersey | 307/317 X |
| 3,339,110 | 8/1967 | Jones, Jr. | 361/13 |
| 3,449,591 | 6/1969 | Hoover | 361/8 |

OTHER PUBLICATIONS

"Microwave Switching Diodes", Microwave Associates Inc., Catalog SF-5001/Mar. 1963; 3 pages.

*Primary Examiner*—Marvin L. Nussbaum
*Attorney, Agent, or Firm*—Eugene A. Parsons

[57] ABSTRACT

A reed relay having pin diodes connected in parallel therewith and forward biased for conduction when the reed relay is actuated, said pin diodes being reversed biased once the reed relay closes so that they are removed from the circuits.

5 Claims, 5 Drawing Figures

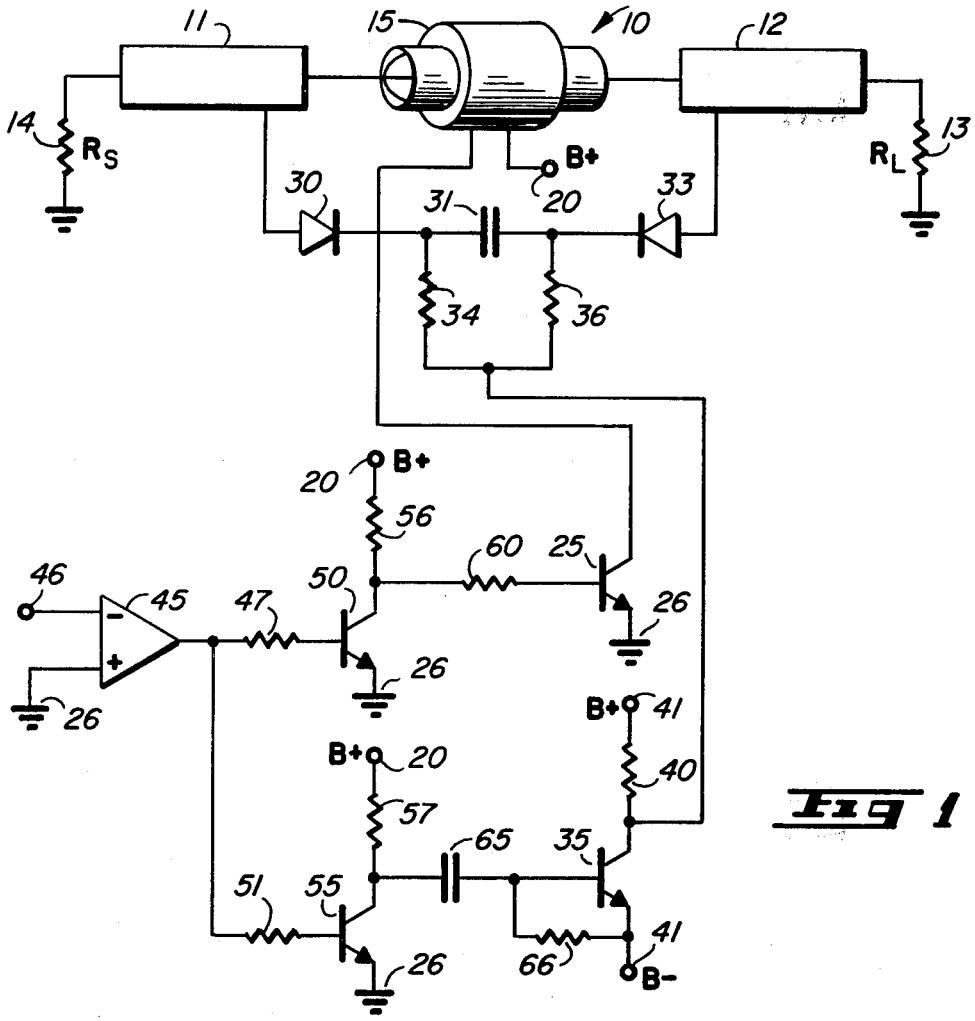
Fig 1
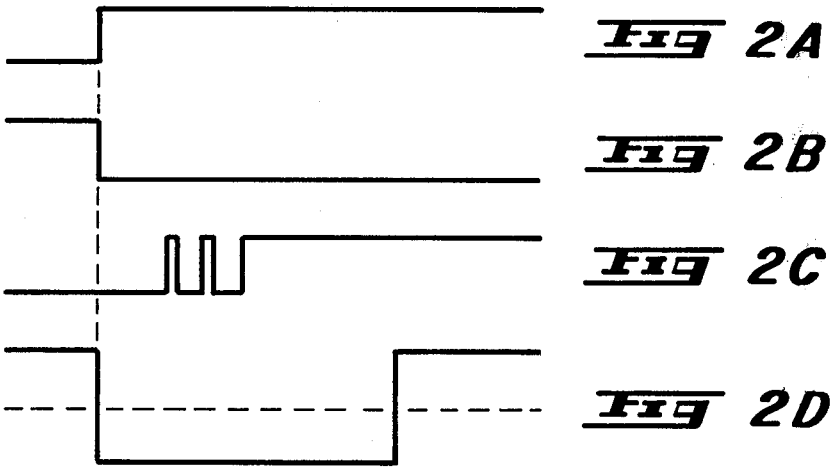
Fig 2A
Fig 2B
Fig 2C
Fig 2D

HIGH POWER RF RELAY SWITCH

BACKGROUND OF THE INVENTION

In many applications, such as transmitters, couplers, antennas, test equipment, etc., it is desirable to provide high power RF switches useable from DC to high RF frequencies. In general, evacuated electromechanical RF relays may be constructed which will provide this function but they are relatively slow and very costly. RF pin diode switches are useful in switching high RF frequencies but they are not useful from DC to low RF frequencies and are generally not capable of switching high power.

SUMMARY OF THE INVENTION

The present invention pertains to a high power RF switch including a relay, pin diodes connected in parallel with the relay contacts and means for forward biasing the pin diodes when the relay contacts are actuated and reverse biasing the pin diodes subsequent to closure of the relay contacts. The pin diodes conduct RF first thus reducing the relay contact voltage drop and current during contact closure. This prevents overdissipation and welding at the relay contacts.

It is an object of the present invention to provide a new and improved high power RF switch.

It is a further object of the present invention to provide a high power RF switch useable from DC to high RF frequencies and under relatively high power requirements.

It is a further object of the present invention to provide a new and improved high power RF switch which is relatively small, inexpensive and easy to manufacture.

These and other objects of this invention will become apparent to those skilled in the art upon consideration of the accompanying specification, claims and drawings.

BRIEF DESCRIPTION OF THE DRAWINGS

Referring to the drawings,

FIG. 1 is a schematic diagram of a high power RF switch embodying the present invention; and FIGS. 2A–2D are timing diagrams illustrating various wave forms available at different points of the schematic of FIG. 1.

DESCRIPTION OF THE PREFERRED EMBODIMENT

Referring specifically to FIG. 1, the numeral 10 generally designates a relay assembly, which in this embodiment is a reed relay operating as a switch between two sections of microstrip circuitry 11 and 12 similar to the apparatus disclosed in a copending U.S. patent application entitled "APPARATUS FOR MOUNTING A REED RELAY", filed Apr. 30, 1979 Ser. No. 034,217 assigned to the same assignee and bearing Motorola Docket No. GE-79862. While this specific reed relay assembly is illustrated because of its convenience and simplicity, it will be understood by those skilled in the art that many other assemblies and types of relays might be utilized. Further, the reed relay assembly 10 includes a generally tubularly shaped coil 15 surrounding the reed switch for actuation thereof. It will also be understood that many other types of actuation means might be utilized if desired. The coil 15 has a pair of terminals for applying power thereto, one of which is connected to a B+ terminal 20 and the other of which is connected to the collector of an NPN transistor 25.

The emitter of the transistor 25 is connected directly to a common terminal 26, which in this embodiment is illustrated as ground. Therefore, when the transistor 25 is turned on by a signal on the base thereof one terminal of the coil 15 is grounded and power is applied by way of the terminal 20 to actuate the reed relay of the assembly 10.

The anode of a first diode 30 is connected to the microstrip circuit 11 and the cathode is connected to one side of a capacitor 31. The anode of a second diode 33 is connected to the microstrip circuit 12 and the cathode is connected to the opposite side of the capacitor 31. Thus, the diodes 30 and 33 are connected in parallel with the coil 15 and in opposed polarity relationship. Further, in this embodiment the diodes 30 and 33 are pin diodes constructed to switch high RF frequency signals.

The junction of the diode 30 and the capacitor 31 is connected through a resistor 34 to the collector of an NPN type transistor 35. The junction of the diode 33 and the capacitor 31 is connected through a resistor 36 to the collector of the transistor 35. The collector of the transistor 35 is also connected through a resistor 40 to a B++ terminal 41 adapted to have applied thereto a positive voltage somewhat higher than the positive voltage applied to the terminal 20. The emitter of the transistor 35 is connected to a B− terminal 41 which is adapted to have a negative voltage applied thereto. Thus, when the transistor 35 is turned on by a positive voltage on the base the diodes 30 and 33 have negative voltage applied to the cathodes thereof and they are forward biased. When the transistor 35 is turned off a positive voltage is applied to the cathodes of the diodes 30 and 33 and they are reverse biased.

An operational amplifier 45 has a noninverting input connected to ground 26 and an inverting input connected to an input terminal 46. The terminal 46 is adapted to receive a control, or actuating, signal such as illustrated in FIG. 2A. The output of the operational amplifier 45 is connected through a resistor 47 to the base of an NPN type transistor 50 and through a second resistor 51 to the base of an NPN type transistor 55. The emitters of the transistors 50 and 55 are both connected to ground 26 and the collectors are connected through resistors 56 and 57, respectively, to the B+ terminal 20. The collector of the transistor 50 is also connected through a resistor 60 to the base of the transistor 25. The collector of the transistor 55 is connected through a timing capacitor 65 to the base of the transistor 35. The base of the transistor 35 is also connected through a resistor 66 to the emitter thereof.

When the positive going signal is applied to the terminal 46 at the input of the operational amplifier 45, the output of the operational amplifier 45 drops sharply, thereby turning off the transistors 50 and 55. When the transistors 50 and 55 turn off a positive potential is applied to the bases of the transistors 25 and 35, turning these transistors on. As mentioned previously, when the transistor 25 turns on the coil 15 is grounded thereby applying a potential thereacross to actuate the reed switch. Also, when the transistor 35 turns on the positive voltage from the terminal 41 is removed from the cathodes of the diodes 30 and 33 and the negative voltage at the terminal 41 is applied thereto. Thus, the diodes 30 and 33 are forward biased so that dc current flows through resistors 14, 13, 34 and 36 and diodes 30 and 33. This provides a low resistance path for RF signals through the diodes 30 and 33 and the capacitor 31 in parallel with the reed switch of the assembly 10. The wave form of FIG. 2B illustrates the potential at the collector of the transistor 25. The wave form of FIG. 2D illustrates the potential at the collector of the transistor 35 while the wave form 2c illustrates the reed relay contact closure including contact bounce. The capacitor 65 connected to the base of the transistor 35 charges to its full potential after a predetermined period of time and the DC bias is removed from the base of the transistor 35 to cause the transistor 35 to turn off. When the transistor 35 turns off, as shown in the latter portion of the FIG. 2D, the positive potential is again applied to the cathodes of the diodes 30 and 33, and they are reverse biased to remove or open the path parallel with the reed relay of the assembly 10.

Thus, the parallel path formed by diodes 30 and 33 is closed during actuation of the relay assembly 10 to conduct the RF and reduce contact voltage drop and currents during the relay contact closure. This prevents over dissipation and welding of the relay contacts. After a predetermined period of time the relay is closed and the actuation means reverse biases the diodes 30 and 33 to remove the parallel path from the circuit. Once the contacts of the relay are closed they are capable of conducting relatively high power from DC to RF. The PIN diodes are turned on for a relatively short time in order to minimize the total energy they must dissipate. The time interval shown in FIG. 2D must only be long enough to assure that the relay contacts are closed and all bouncing has ceased. The method shown in this disclosure for control of the diodes "on" time interval is energy storage in capacitor 65, however many other timing means may be used to determine this time interval. This circuitry substantially increases the life of the reed relay and allows switching with RF present.

While we have shown and dicussed a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

We claim:

1. A high power RF switch comprising:

(a) relay means having an input and an output and an actuating coil;

(b) at least two pin diodes connected in opposed polarity relationship in parallel with said relay means generally between the input and output thereof;

(c) semiconductor switching means connected to the actuating coil of said relay means and to said two pin diodes for operating in response to a single input signal to energize the actuating coil of said relay means and forward bias said two pin diodes; and (d) timing means included in said semiconductor switching means for operating said semiconductor switching means to reverse bias said two pin diodes subsequent to closure of said relay means while maintaining the actuating coil energized as long as the input signal is present.

2. A high power RF switch as claimed in claim 1 wherein the semiconductor switching means includes a first controllable semiconductor connected to complete an energizing circuit to the actuating coil in response to the input signal.

3. A high power RF switch as claimed in claim 2 wherein the semiconductor switching means further includes a second semiconductor controllable between first and second modes and connected to apply a forward bias to the pin diodes in the first mode and to apply a reverse bias to the pin diodes in the second mode, and a timing capacitor connected to convey the input signal to the second semiconductor for initially controlling the second semiconductor to the first mode and after charging of the capacitor controlling the second semiconductor to the second mode.

4. A high power RF switch as claimed in claim 1 wherein the relay means includes a reed relay mounted coaxially in a tubular shield to form a transmission line section of predetermined impedance.

5. In conjunction with a relay, having movable contacts connected between an input and an output and an actuating coil, and two pin diodes connected in opposed polarity relationship in parallel with the movable contacts, a method of switching high power RF comprising the steps of:

(a) substantially simultaneously energizing the actuating coil of the relay and forward biasing the pin diodes to provide a conduction path in parallel with the movable contacts; and (b) reverse biasing the pin diodes subsequent to closure of the movable contacts while maintaining the actuating coil energized.

* * * * *